US005301430A

United States Patent [19]

Brenton et al.

[11] Patent Number: 5,301,430

[45] Date of Patent: * Apr. 12, 1994

[54] INTERCHANGEABLE RINGLETS FOR PIVOTED GRASPING INSTRUMENTS

[76] Inventors: Billy H. Brenton, P.O. Box 1656, Los Lunas, N. Mex. 87031; James J. Stagnone, 2426 Vista Grande, NW., Albuquerque, N. Mex. 87120

[ * ] Notice: The portion of the term of this patent subsequent to Jun. 30, 2009 has been disclaimed.

[21] Appl. No.: 907,107

[22] Filed: Jun. 30, 1992

Related U.S. Application Data

[62] Division of Ser. No. 393,676, Aug. 14, 1989, Pat. No. 5,125,159.

[51] Int. Cl.[5] ..... B26B 13/00

[52] U.S. Cl. ..... 30/232; 30/260; 30/341

[58] Field of Search ..... 30/232, 254, 257, 260, 30/341

[56] References Cited

U.S. PATENT DOCUMENTS

| | | | |
|---|---|---|---|
| 1,108,572 | 8/1914 | Gordon | 30/232 |
| 2,579,773 | 12/1951 | Williams | 30/254 |
| 3,906,630 | 9/1975 | Megna | 30/260 |
| 4,184,249 | 1/1980 | Megna et al. | 30/341 |
| 4,254,551 | 5/1981 | Megna et al. | 30/341 |
| 4,453,311 | 6/1984 | Twigger | 30/254 |
| 5,007,170 | 4/1991 | Mayama | 30/232 |
| 5,125,159 | 6/1992 | Brenton et al. | 30/232 |

*Primary Examiner*—Richard K. Seidel
*Assistant Examiner*—Hwei-Siu Payer
*Attorney, Agent, or Firm*—Samuel M. Freund

[57] ABSTRACT

Interchangeable finger and thumb ringlets are described for improving the comfort and control of scissors and pivoted grasping instruments. Flexible ringlets having various sizes are removably attached to the handle portions of such instruments, thereby providing proper fit to the user's fingers.

4 Claims, 2 Drawing Sheets

INTERCHANGEABLE RINGLETS FOR PIVOTED GRASPING INSTRUMENTS

This is a divisional of copending application Ser. No. 07/393,676 filed on Aug. 14, 1989, now U.S. Pat. No. 5,125,159.

BACKGROUND OF THE INVENTION

The present invention relates generally to pivoted cutting and grasping instruments, and more particularly to the use of interchangeable thumb and index finger ringlets to increase the ease and flexibility of use thereof and to reduce the effort involved and fatigue resulting from prolonged use.

Modifications which would allow for greater comfort for the surgeon or barber in the use of surgical scissors and forceps and hair cutting scissors, respectively, have been few, the most notable being the use of finger and thumb ringlets. However, the advantages deriving from the use of such ringlets, such as better control and reduced fatigue, are significantly decreased if they do not properly fit the user's fingers.

Accordingly it is an object of the present invention to provide pivoted cutting and grasping instruments having interchangeable thumb and finger ringlets having various sizes such that virtually any user may comfortably and precisely utilize instruments fitted with them.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the pivoted cutting and grasping devices of this invention include a conventional pivoted cutting or grasping instrument modified to have interchangeable, rotatable and pivotable thumb and finger ringlets or bows attached to the handles thereof.

Preferably, the ringlets are fabricated from soft, but sturdy plastic material to provide additional flexibility in the motion obtainable.

It is preferred that single-piece, hand-adjustable tensioning means be utilized to provide the pivot/tension function more commonly provided by a screw or rivet in conventional pivoted cutting and grasping instruments.

Benefits and advantages of the subject invention include reduction of fatigue and more precise control in the use of the pivoted grasping and cutting devices hereof.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF THE INVENTION

Briefly, the present invention includes the use of interchangeable finger and thumb ringlets for improving the comfort and control of scissors and pivoted grasping instruments. Flexible ringlets having various sizes are removably attached to the handle portions of such instruments, thereby providing proper fit to the user's fingers.

Figure 1A:
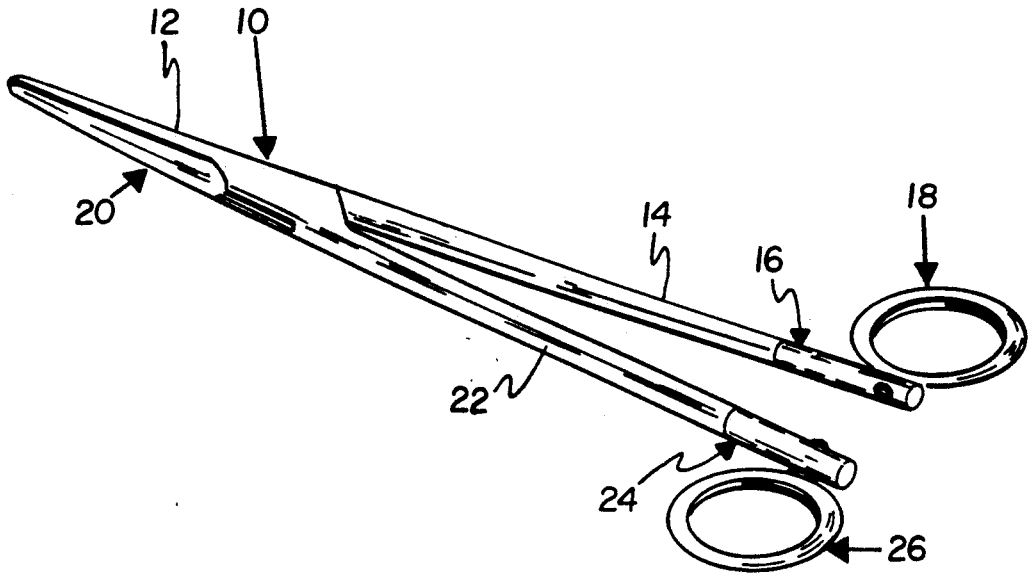
FIG. 1*a* is a schematic representation of a perspective view of the grasping or clamping instrument embodiment of the present invention shown in its closed configuration.

Reference will now be made in detail to the present preferred embodiments of the invention, examples of which are illustrated in the accompanying drawings. Similar or identical structure is identified by identical callouts. In what follows, description will be focused on pivoted grasping or clamping instruments. Turning now to the Figures, FIG. 1*a* is a schematic representation of a perspective view of the grasping instrument of the present invention in its closed configuration. Shank member 10 includes a grasping or clamping portion 12 and a handle portion 14. Handle extension means 16 is rigidly attached to the handle portion and provides a manner in which currently-available grasping instrument may be retrofitted to include interchangeable ringlets. Ringlet 18 is rotatably attached to extension 16. It is preferred that ringlets be constructed from flexible materials so that additional motion is available to an inserted digit of the user of the device. Adjacent shank member 20 is similarly constructed, and has a grasping clamping portion (not shown) and a handle portion 22, shank members 10 and 20 forming a grasping or clamping instrument. Handle extension 24 is shorter than opposing extension 16 in order to more ergonometrically fit the user's hand. Ringlet 26 is rotatably attached thereto.

Figure 1B:
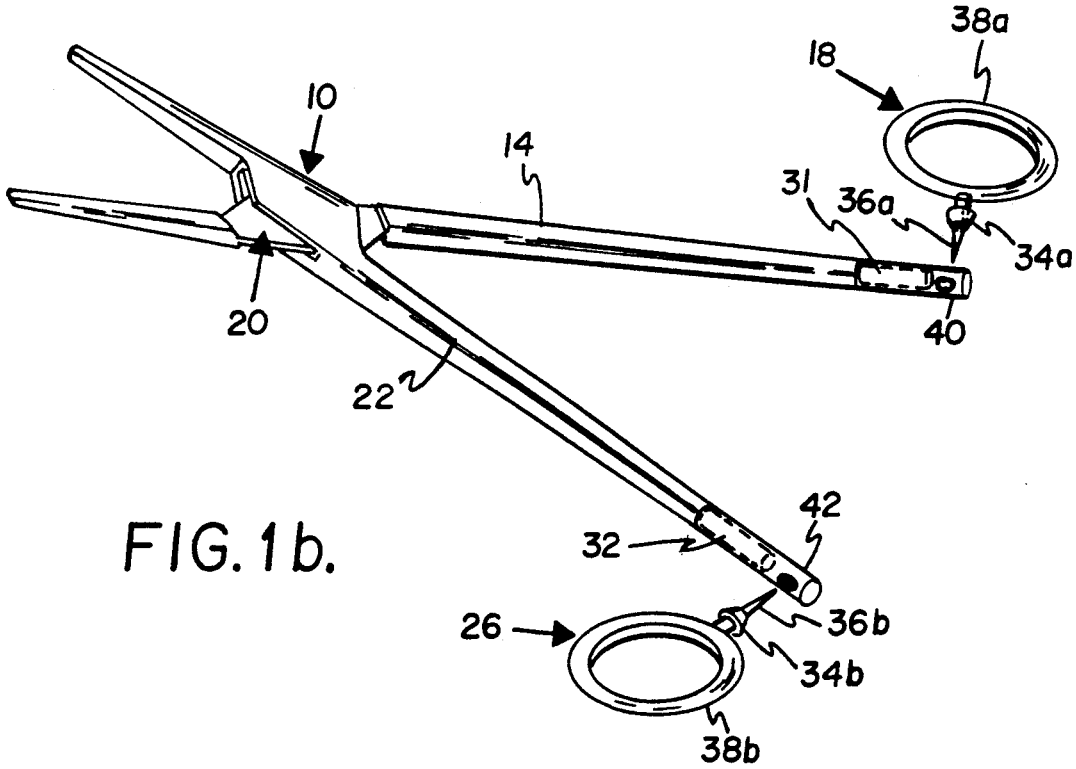
FIG. 1*b* is a schematic representation of an exploded view of the embodiment of the present invention shown in FIG. 1*a* showing in particular, the grasping or clamping portion, handles, thumb and finger ringlets.

FIG. 1*b* is an exploded schematic representation of the grasping or clamping instrument shown in FIG. 1*a* hereof, more clearly showing the component parts thereof. Shown also are modifications to the handle portions of a commercial grasping or clamping instrument 31, 32 which have had their conventional ringlets or finger bows removed in order to adapt them for attachment to handle extensions 16 and 24, respectively. Of course, one could have originally fabricated grasping or clamping instrument having handles adapted to receive ringlets 18 and 26 directly and without the need for extensions. Ringlets 18 and 26 are fabricated having an arm **34*a* and 34*b*, respectively, disposed generally radially to a ring member 38*a* and 38*b*, respectively, adapted to be rotatably inserted into holes 40 and 42, respectively, in handle extensions 16 and 24, respectively, with each arm having a deformable enlarged portion at the terminus thereof. Extension arms 36*a* and 36*b*, respectively, are sturdily attached to the enlarged portions of arms 34*a* and 34*b*, respectively, and are adapted to be readily inserted into holes 40 or 42** in order to permit the deformable enlarged portion to be pulled through the holes in the handle extensions using a pliers or some other gripping device. Once inserted into the hole, the deformable enlarged portions prevent the escape of the ringlets during use, and the extension arm may be cut off. If another ringlet is to be installed, the enlarged portion is simply cut off from the installed ringlet and that ringlet discarded.

Figure 2:
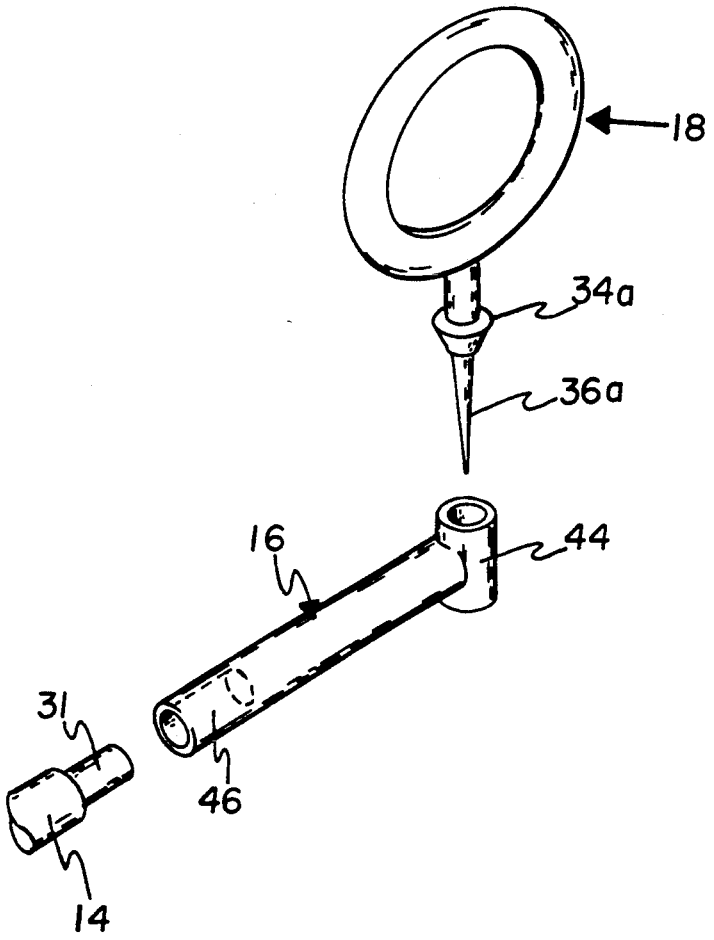
FIG. 2 is a schematic representation of another embodiment of the handles of the present invention showing an alternative method for attaching the finger and thumb ringlets thereto.

FIG. 2 is a schematic representation of another embodiment of the present invention showing a variation of the handle extensions 16 and 24 to include a tubular section 44 located at the terminus thereof having its axis disposed in a substantially perpendicular manner to the axis of the handle extension and adapted to receive ringlet 18. Handle extension 16 has a hole 46 bored along the axis thereof in order to enable it to receive the reduced diameter terminus 31 of grasping or clamping instrument handle 14 to which it is rigidly attached. Handle extensions are preferably fabricated from plastic materials in order to reduce the cost and weight of the resulting pivoted instrument.

The foregoing description of several preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What we claim is:

1. A pivoted grasping clamping instrument having interchangeable ringlets comprising in combination:

a first shank member having a handle portion and a grasping portion approximately separated by a first pivot location;

first elongated handle extension means rigidly attached to the handle portion of said first shank member substantially near to the terminus thereof away from the first pivot location, said first handle extension means having a tubular portion located at the end thereof opposite the position of attachment thereof to said first shank member and disposed substantially perpendicular to the long dimension thereof;

first flexible ring means having a ring-shaped portion and a generally cylindrical arm attached radially thereto, the arm having an enlarged deformable terminus;

a second shank member having a handle portion and a grasping portion approximately separated by a second pivot location, said second shank member being pivotably connected to said first shank member in the region of the first pivot location and the second pivot location in such a manner that the grasping portion of said first shank member and the grasping portion of said second shank member cooperate as opposing grasping portions of a grasping instrument;

second elongated handle extension means rigidly attached to the handle portion of said second shank member substantially near to the terminus thereof away from the second pivot location, said second handle extension means having a tubular portion located at the end thereof opposite the position of attachment thereof to said second shank member and disposed substantially perpendicular to the long dimension thereof; and second flexible ring means having a ring-shaped portion and a generally cylindrical arm attached radially thereto, the arm having an enlarged deformable terminus; whereby the cylindrical arm of said first ring means can be inserted into the tubular portion of said first handle extension means forming thereby a rotatable thumb ringlet, the enlarged terminus thereof and the ring-shaped portion preventing escape therefrom, and the cylindrical arm of said second ring means can be inserted into the tubular portion of said second handle extension means forming thereby a rotatable finger ringlet, the enlarged terminus thereof and the ring-shaped portion preventing escape therefrom.

2. The pivoted grasping instrument as described in claim 1, wherein said first ring means and said second ring means further comprise an arm extension located on the cylindrical arm thereof on the opposite side of the enlarged deformable terminus thereof from the ring-shaped portion, the arm extension adapted for insertion into the tubular portion of said first handle extension means and said second handle extension means.

3. A pivoted grasping clamping instrument having interchangeable ringlets comprising in combination:

a first shank member having a handle portion and a grasping portion approximately separated by a first pivot location the handle portion thereof having a tubular portion located at the end thereof opposite the position of the first pivot location disposed substantially perpendicular to the long dimension thereof;

first flexible ring means having a ring-shaped portion and a generally cylindrical arm attached radially thereto, the arm having an enlarged deformable terminus;

a second shank member having a handle portion and a grasping portion approximately separated by a second pivot location, said second shank member being pivotably connected to said first shank member in the region of the first pivot location and the second pivot location in such a manner that the grasping portion of said first shank member and the grasping portion of said second shank member cooperate as opposing grasping portions of a grasping instrument, the handle portion of said second shank member having a tubular portion located at the end thereof opposite the position of the second pivot location disposed substantially perpendicular to the long dimension thereof; and second flexible ring means having a ring-shaped portion and a generally cylindrical arm attached radially thereto, the arm having an enlarged deformable terminus; whereby the cylindrical arm of said first ring means can be inserted into the tubular portion of said first shank member forming thereby a rotatable thumb ringlet, the enlarged terminus thereof and the ring-shaped portion preventing escape therefrom, and the cylindrical arm of said second ring means can be inserted into the tubular portion of said second shank member forming thereby a rotatable finger ringlet, the enlarged terminus thereof and the ring-shaped portion preventing escape therefrom.

4. The pivoted grasping instrument as described in claim 3, wherein said first ring means and said second ring means further comprise an arm extension located on the cylindrical arm thereof on the opposite side of the enlarged deformable terminus thereof from the ring-shaped portion, the arm extension adapted for insertion into the tubular portion of said first shank member and said second shank member.

* * * * *